US006551358B2

(12) United States Patent
Miller et al.

(10) Patent No.: US 6,551,358 B2
(45) **Date of Patent: *Apr. 22, 2003**

(54) ALKALINE ENZYME SCOURING OF COTTON TEXTILES

(75) Inventors: Carl Andrew Miller, Knightdale, NC (US); Steen Skjold Jorgensen, Rungsted (DK); Eric W. Otto, Louisburg, NC (US); Niels K. Lange, Raleigh, NC (US); Brian Condon, Wake Forest, NC (US); Jiyin Liu, Raleigh, NC (US)

(73) Assignee: Novozymes A/S, Bagsvaerd (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/247,390

(22) Filed: Feb. 10, 1999

(65) Prior Publication Data

US 2002/0002746 A1 Jan. 10, 2002

Related U.S. Application Data

(63) Continuation of application No. 08/977,587, filed on Nov. 25, 1997, now Pat. No. 5,912,407.
(60) Provisional application No. 60/034,314, filed on Dec. 4, 1996.

(51) Int. Cl.[7] ..... D06M 16/00
(52) U.S. Cl. ..... 8/139; 162/72; 162/91; 162/95; 435/263; 435/264; 510/530; 510/320; 510/392; 8/137
(58) Field of Search ..... 162/72, 91, 95; 8/139, 137; 435/263, 264; 510/320, 321, 323, 392, 393, 395, 530

(56) References Cited

U.S. PATENT DOCUMENTS

| | | | | |
|---|---|---|---|---|
| 4,443,355 A | * | 4/1984 | Murata et al. | 252/174.12 |
| 4,568,739 A | | 2/1986 | Jaskowski | 536/2 |
| 5,290,474 A | * | 3/1994 | Clarkson et al. | 252/174.12 |
| 5,487,812 A | | 1/1996 | Thorton et al. | 162/72 |
| 5,629,278 A | * | 5/1997 | Baeck et al. | 510/236 |
| 5,770,437 A | * | 6/1998 | Lantero, Jr. et al. | 435/277 |
| 5,789,362 A | * | 8/1998 | Baeck et al. | 510/226 |
| 5,837,010 A | * | 11/1998 | Baeck et al. | 8/137 |
| 5,866,526 A | * | 2/1999 | Olsen et al. | 510/392 |
| 5,872,091 A | * | 2/1999 | Cuperus et al. | 510/300 |
| 5,880,080 A | * | 3/1999 | Amory et al. | 510/320 |
| 5,912,407 A | * | 6/1999 | Miller et al. | 8/139 |

FOREIGN PATENT DOCUMENTS

| | | |
|---|---|---|
| EP | 0 622 487 A2 | 11/1994 |
| GB | 750352 | 6/1956 |
| GB | 2 168 393 A | 6/1996 |
| JP | 51-149976 | 12/1976 |
| JP | 2-118191 | 5/1990 |
| JP | 4-289206 | 10/1992 |
| WO | WO 95/09909 | 4/1995 |

OTHER PUBLICATIONS

Henrissat, Bernard et al., "Functional Implications of Structure–Based Sequence Alignment of Proteins in the Extracellular Pectase Lyase Superfamily", Plant Physiol, (1995) 107: 963–976.*
Derwent Database Abstract—JP 02118191 A, May 2, 1990.*
Derwent Database Abstract—DE 3635427 A, Apr. 23, 1987.*
Bach et al. (1992) "Kinetische Untersuchungen zum enzymatischen Abbau von Baumwollpektin" Textilveredlung 27(1):2–6.
Röβner, U. (1993) "Enzymatischer Abbau von Baumwollbegleitsubstanzen" Melliand Textilberichte, Int'l. Textile Reports 74(2):144–148.
Abstract—Database WPI Wk. 7706 Derwent Publ. Ltd. London, AN 77–10262Y XP002059813 for JP 51149976 A.
Abstract—Database WPI WK 9248 Derwent Publ. Ltd. London, AN 92–392407 XP002059814 for JP 04289206 A.
Bach et al. (1992) "Kinetische Untersuchungen zum enzymatischen Abbau von Baumwollpektin" Textilveredlung 27(1):2–6.
Röβner, U. (1993) "Enzymatischer Abbau von Baumwollbegleitsubstanzen" Melliand Textilberichte, Int'l. Textile Reports 74(2):144–148.
Abstract—Database WPI Wk. 7706 Derwent Publ. Ltd. London, AN 77–10262Y XP002059813 for JP 51149976 A.
Abstract—Database WPI WK 9248 Derwent Publ. Ltd. London, AN 92–392407 XP002059814 for JP 04289206 A.

* cited by examiner

*Primary Examiner*—Cynthia H. Kelly
*Assistant Examiner*—Dawn Garrett
(74) *Attorney, Agent, or Firm*—Elias Lambiris; Jason Garbell

(57) ABSTRACT

The invention relates to a process for treatment of cellulosic material, as for example, knitted or woven cotton fabric, comprising the steps of preparing an aqueous enzyme solution comprising pectinase, treating the cellulosic material with an effective amount of the aqueous enzyme solution under alkaline scouring conditions; e.g., pH of 9 or above and a temperature of 50° C. or above, in a low calcium or calcium-free environment, yielding a modification of the cellulosic material such that exhibits an enhanced respond to a subsequent chemical treatment.

6 Claims, No Drawings

ALKALINE ENZYME SCOURING OF COTTON TEXTILES

CROSS REFERENCE TO RELATED APPLICATIONS

Priority of U.S. provisional application serial No. 60/034,314 filed on Dec. 4, 1996 is claimed under 35 U.S.C. 119. This application is a continuation of 08/977,587 filed on Nov. 25, 1997 now U.S. Pat. No. 5,912,407, in the U.S. is claimed under 35 U.S.C. 120, the contents of which are fully incorporated herein by reference.

FIELD OF THE INVENTION

The present invention relates to a process for treatment of cellulosic material, as for example, knitted or woven cotton fabric. More specifically, the invention relates to a process for enzymatic bioscouring of cellulosic material under alkaline conditions.

BACKGROUND

DESCRIPTION OF THE RELATED ART

The processing of cellulosic material, as for example cotton fiber, into a material ready for garment manufacture involves several steps: spinning of the fiber into a yarn; construction of woven or knit fabric from the yarn and subsequent preparation, dyeing and finishing operations. Woven goods are constructed by weaving a filling yarn between a series of warp yarns; the yarns could be two different types. Knitted goods are constructed by forming a network of interlocking loops from one continuous length of yarn. The preparation process prepares the textile for the proper response in dyeing operations. The sub-steps involved in preparation are desizing (for woven goods), scouring and bleaching. A one step combined scour/bleach process is also used in the industry.

The processing regime can be either batch or continuous with the fabric being contacted by the liquid processing stream in open width or rope form. Continuous operations generally use a saturator whereby chemicals are applied to the fabric, followed by a heated dwell chamber where the chemical reaction takes place. A washing section then prepares the fabric for the next processing step. Batch processing generally takes place in one processing bath whereby the fabric is circulated through the bath. After a reaction period, the chemicals are drained, fabric rinsed and the next chemical is applied. Discontinuous pad-batch processing involves a continuous application of processing chemical followed by a dwell period which in the case of cold pad-batch might be one or more days. Desizing. Woven goods are the prevalent form of textile fabric construction. The weaving process demands a "sizing" of the warp yarn to protect it from abrasion. Starch, polyvinyl alcohol, carboxymethyl cellulose, waxes and acrylic binders are examples of typical sizing chemicals used because of availability and cost. The size must be removed after the weaving process as the first step in preparing the woven goods.

The sized fabric in either rope or open width form is brought in contact with the processing liquid containing the desizing agents. The desizing agent employed depends upon the type of size to be removed. The most common sizing agent for cotton fabric is based upon starch. Therefore most often, woven cotton fabrics are desized by a combination of hot water, the enzyme alpha amylase and a wetting agent or surfactant. The cellulosic material is allowed to stand with the desizing chemicals for a "holding period" sufficiently long to accomplish the desizing. The holding period is dependent upon the type of processing regime and the temperature and can vary from 15 minutes to 2 hours, or in some cases, several days. Typically, the desizing chemicals are applied in a saturator bath which generally ranges from about 15° C. to 60° C. The fabric is then held in equipment such as a "J-box" which provides sufficient heat, usually between 50° C. to 100° C. to enhance the activity of the desizing agents. The chemicals, including the removed sizing agents, are washed away from the fabric after the termination of the holding period.

In order to ensure a high whiteness and/or a good dyeability, the size and other applied must be thoroughly removed, and it is generally believed that an efficient desizing is of crucial importance to the following preparation processes: scouring and bleaching.

Scouring.

The scouring process removes much of the non-cellulosic compounds naturally found in cotton. In addition to the natural non-cellulosic impurities, scouring can remove residual manufacturing introduced materials such as spinning, coning or slashing lubricants. The scouring process employs sodium hydroxide or related causticizing agents such as sodium carbonate, potassium hydroxide or mixtures thereof. Generally an alkali stable surfactant is added to the process to enhance solubilization of hydrophobic compounds and/or prevent their redeposition back on the fabric. The treatment is generally at a high temperature, 80° C.–100° C., employing strongly alkaline solutions of the scouring agent, e.g., pH 13–14. Due to the non-specific nature of chemical processes not only are the impurities but the cellulose itself is attacked, leading to damages in strength or other desirable fabric properties. The softness of the cellulosic fabric is a function of residual natural cotton waxes. The non-specific nature of the high temperature strongly alkaline scouring process cannot discriminate between the desirable natural cotton lubricants and the manufacturing introduced lubricants. Furthermore, the conventional scouring process can cause environmental problems due to the highly alkaline effluent from these processes.

The scouring stage prepares the fabric for the optimal response in bleaching. An inadequately scoured fabric will need a higher level of bleach chemical in the subsequent bleaching stages.

Bleaching.

The bleaching step decolorizes the natural cotton pigments and removes any residual natural woody cotton trash components not completely removed during ginning, carding or scouring. The main process in use today is an alkaline hydrogen peroxide bleach. In many cases, especially when a very high whiteness is not needed, bleaching can be combined with scouring. The combined process does however require higher dosages of bleach chemicals. The optimal temperature for bleaching is 60° C.–70° C.

In order to minimize quantity of the expensive hydrogen peroxide, adjuncts such as chelators and stabilizers, sodium silicate and surfactants are often employed. As all of these compounds ultimately find their way into the effluent from textiles processes, it is advantageous to minimize their usage.

Enzymatic Treatment of Textiles.

The enzyme α-amylase has been used in the textile industry for the removal of size for many years; indeed, it is one of the earliest known industrial applications of enzymes. Cellulase enzymes have been used in garment finishing applications to mimic the effects of stone washing of denim for the past 8–10 years. The use of the enzyme was rapidly accepted due to the environmental and process benefits. The use of cellulases to bio-polish knits to prevent or inhibit pilling is also known. The enzyme catalase is used in the industry as a milder, more environmentally conscious method to destroy residual hydrogen peroxide in exhausted bleach baths.

Recently, peroxidases and laccases, in combination with mediators are being proposed as a means to decrease the environmental and structural damage caused by the use of chlorine-containing bleaching for some garment finishing applications. Peroxidase enzymes are used in combination with hydrogen peroxide or a source thereof (e.g., a percarbonate, perborate or persulfate). Oxidase enzymes are used in combination with oxygen. Both types of enzymes are used for "solution bleaching", i.e., to prevent transfer of a textile dye from a dyed fabric to another fabric when said fabrics are washed together in a wash liquor, preferably together with an enhancing agent as described in e.g., WO 94/12621 and WO 95/01426. Suitable enzymes for the treatment of textiles include those of plant, bacterial or fungal origin. Chemically or genetically modified mutants are included.

The scouring and bleaching operations employ massive doses of caustic chemicals such as sodium hydroxide and hydrogen peroxide at high temperatures. The cost of these chemicals is substantial, both from the standpoint of initial purchase and environmental burden cost upon disposal of the waste from the operations. The non-selective nature of the process also results in structural damage to the cellulose in the cotton. The impurities in cotton are naturally occurring compounds and as such should be able to be hydrolyzed and removed by enzymes. Various enzymes have been proposed to effect a scouring response. Japanese patent JP 7572747 describes a scouring method for vegetable derived cellulosic fibers, in particular ramie, by using a cellulose decomposing enzyme and a pectin decomposing enzyme. East German patent DD 264947 A1 describes a method to pretreat cotton by using a fungal enzyme complex as desizing agent. The complex may contain fungal cellulase, hemicellulase, pectinase and protease in addition to an amylase derived from fungal, animal, bacterial or vegetable origin. Benefits claimed are an avoidance of alkali and a reduced contamination of waste water. Schollmeyer and Bach describes that the treatment of raw cotton fiber with pectinase and pectinase/cellulase combinations can be bleached to a greater whiteness with hydrogen peroxide than alkaline scoured raw cotton fiber. While the pectinase/cellulase treated and bleached fabric was whiter than the pectinase alone bleached sample, the strength loss was much greater. In contrast, Rossner (Meilland Textilberichte 2/1993, p. 144–148) describes that cotton fabric treated with enzymes and subsequently bleached with hydrogen peroxide cannot be bleached to as great a whiteness as alkaline scoured and bleached fabric. Japanese patent JP 6220772 describes that an enzyme capable of releasing intact pectin from cotton can have a scouring response; the benefits being a milder treatment with reduced energy and lower cost of water disposal without environment pollution. The use of an oil and fat decomposing enzyme either alone or in combination with the pectin liberating enzyme is described in Japanese patent application 6-263524. The benefit of this procedure being the same as those previously described. The harshness of known scouring treatments result in reduced fabric characteristics. Further, the current processes requiring multiple processing steps at different pH and temperature conditions are time consuming and inefficient. Thus, there is a need for an improved scouring process which does not result in a reduction of superior fabric characteristics, as well as a need for more efficient processes.

BRIEF SUMMARY OF THE INVENTION

In one aspect, the invention features an enzymatic scouring method which is conducted under alkaline conditions, specifically at a pH of 9.0 or greater. Accordingly, in one embodiment, the method features a process for treatment of cellulosic material, comprising the steps of (a) mixing an aqueous enzyme solution comprising pectinase, and (b) treating cellulosic material with an effective amount of the pectinase solution of step (a) to achieve scouring, at a pH of 9.0 or above, a temperature of 50° C. or above, in a low calcium environment of up to 0.2 mM. The treated material exhibits an enhanced response to a subsequent chemical treatment, such as bleaching. Further, the treated material exhibits superior fabric characteristics, such as whiteness and strength, due to reduction in the harshness of its chemical treatment.

In more specific embodiments, the aqueous enzyme solution of the invention further comprises one or more enzymes selected from the group consisting of protease, glucanase, and cellulase. In one specific embodiment, the enzyme solution is comprised of no more than four different enzymes, where at least 3 each represent more than 10% of total enzyme protein and all four, if present, represent at least 50% of total protein. In related embodiments, the enzyme solution may further comprise an amylase and/or a lipase used for the simultaneous removal of starch sizing from woven fabric.

The bioscouring method of the invention is conducted in a low calcium or calcium-free environment, obtained by selection of components containing low or no calcium, e.g., distilled water, or by addition of a calcium chelator or sequestrant. The term "low calcium" 95 used herein, is meant to include a calcium-free wash liquor, or a environment of less than 0.2 mM $Ca^{++}$.

The method of the invention includes the addition of a calcium sequestrant or chelator to the pectinase-containing enzyme solution. While any calcim sequestrant or chelation system may be used in the method of the invention, preferred sequestrants or chelating agents include aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate sequestrants can also be used herein. In one embodiment of the invention, the calcium sequestrant is ethylenediamine tetraacetate (EDTA) added to a wash liquor in an amount sufficient to reduce calcium concentration to less than 0.2 mM. In a specific embodiment, EDTA is added in the amount of up to 2 mM.

In related embodiments, the fabric treated by the method of the invention is further subjected to one or more desired chemical treatments. In specific embodiments, the chemical treatment consists of using hydrogen peroxide and sodium hydroxide, or may comprise use of a causticizing agent selected from the group consisting of sodium carbonate, potassium hydroxide or sodium hydroxide, and an oxidizing agent selected from the group of sodium perborate, percarbonate, sodium hypochlorite or hydrogen peroxide.

Examples of the cellulosic material which can be treated include but is not limited to cotton fiber, yarn, knitted or woven cotton fabric. Cellulosic fibers and fabrics from other sources such as flax, linen, ramie or their blends would also be suitable material for this treatment. Blends of the cellulosic materials with manmade fibers such as polyester would also benefit from this technology. The utilization of textile adjuncts such as surfactants, sequestrants, antiredeposition agents, etc, along with the aqueous enzyme treatment is anticipated to be a preferred practice and has been shown in selected examples to result in an improved effect. The process, when in combination with alkaline compatible desizing or bio-polishing enzymes, is a particularly useful embodiment of the invention.

One objective of the invention is to provide an improved method for scouring cellulosic material which yields a fabric having superior characteristics wettability, dyeability, and softness (hand).

One advantage of the invention is to provide a more efficient processing method for cellulosic material.

A feature of the invention is a shortened time period required to achieve scouring of cellulosic material.

These and other objectives, advantages, and features of the invention will become apparent to those persons skilled in the art upon reading the details of the method as more fully described below.

DETAILED DESCRIPTION OF THE INVENTION

Before the present method and enzyme solutions used in the method are described, it is to be understood that this invention is not limited to particular methods, or enzyme solutions described, as such methods and solutions may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

The present invention relates to an improved method of scouring cellulosic material, using an aqueous enzyme solution comprising pectinase, and treating the cellulosic material with the enzyme solution at a pH of 9.0 or higher and temperature of 50° C. or higher, wherein the scouring step is conducted in a wash liquor having a low calcium concentration of less than 0.2 mM. The method of the invention is milder than conventional scouring methods, thereby resulting in a fabric having superior quality characteristics, such as improved whiteness and strength.

The aqueous enzyme solution can further comprise one or more enzymes selected from the group consisting of protease, glucanase, and cellulase. In a preferred embodiment, the enzyme solution is comprised of essentially only monocomponent enzymes; only one unique enzyme protein from each of the broad classes described by the invention is present in the enzyme solution.

In further embodiments, the aqueous enzyme solution of the invention may be co-formulated with selected textile adjuncts which can further boost the enhanced scouring effect.

Free calcium ions are undesirable in any scouring process as they tend to form insoluble salts which precipitate on the surface of fibers. The instant invention is conducted in a low calcium environment, wherein calcium ion concentration is 0–0.2 mM.

The low calcium ion environment of the invention may be achieved by selection of low calcium or calcium-free components, e.g., use of distilled water for the wash liquor, or by the addition of an agent which removes free calcium ions from solution, e.g., a calcium sequestrant or chelator.

A. Process for Treatment of Cellulosic Material.

In one aspect, the present invention is directed to a process for scouring cellulosic material, using an aqueous enzyme solution comprising pectinase, and treating the cellulosic material with the enzyme solution at a pH of 9.0 or higher and temperature of 50° C. or higher, in a low calcium or calcium-free environment or wash liquor. The treated material exhibits an enhanced response to a subsequent chemical treatment and superior fabric characteristics, such as whiteness and strength.

Additionally, the method of the invention reduces the time required to achieve scouring. Reaction time requirements are of considerable industrial importance as the effect both production capacity at a textile mill, as well as cost. Thus, the present invention provides a scouring process with a reaction time of less than 4 hours, preferably less than 1.5 hours, and most preferably less than 0.5 hours.

Depending on the type of cellulosic material to be treated, the aqueous enzyme will have a total weight of 0.5–30 times the weight of the cellulosic material to be treated. Preferred enzymes include pectinase, as a complex protein mixture or monocomponent. The aqueous enzyme solution of the invention may further comprise protease, glucanase, amd cellulase, also as complex protein mixtures or monocomponents. It should be understood by those skilled in the art that any other aqueous enzyme or combination of enzymes including compatible formulations with surfactants and sequestrants can be used which provide for an enhanced whiteness effect of the cellulosic material.

The "effective amount" of aqueous enzyme solution is defined as the amount of enzyme which will result in an enhanced scour effect of the cellulosic material as compared to the treatment with chemical scouring agents alone. It should be appreciated that the "effective amount" will be dependent on various parameters including: the concentration of the aqueous enzyme solution, the pH of the solution, the time the solution is applied, and the temperature of the solution. The effective amount of the enzyme solution will also be dependent upon other intended or non-intended chemicals present. The combination of the aqueous enzyme solution with common textile industry surfactants, sequestrants or other commonly employed agents can accelerate or completely destroy the enhanced scouring effect.

The method of applying the enzyme solution to the cellulosic material depends upon the type of processing regime; continuous, discontinuous pad-batch or batch. In the embodiment of continuous application, the aqueous enzyme solution is held in a saturator bath and is applied continuously to the fabric as it travels through the bath. This type of application is suitable for continuous or discontinuous pad-batch processing. Typically, the fabric to be treated will absorb the processing liquor at a level of 0.5–1.5 times its weight. Alternatively, in batch operations, the fabric is continuously exposed to a more dilute enzyme solution; typically processing liquor to fabric ratios for batch operations are 8:1–15:1. Consequently, concentration of enzyme protein in the aqueous enzyme solution is dependent upon the type of process but typically, when expressed on weight of cellulosic material to be treated will range between 0.001% and 0.5%.

During continuous application of the aqueous enzyme solution, the temperature of the saturator bath solution is preferably at least 20° C., preferably about 35° C.–60° C.

The dwell temperature, defined as the temperature maintained during the contact period of the cellulosic material with the aqueous enzyme solution, is at least about 20° C. preferably about 35° C.–100° C.

For batch operations, the aqueous enzyme solution is maintained in contact with the cellulosic material for a period ranging from about 0.25 hours and up to a maximum for very dilute aqueous enzyme solutions or ambient temperature operations of several to 24 hours. The temperature during the reaction periods will range from 20° C. to as high as 100° C., depending upon the enzyme solution selected and the time available for processing. The solution pH will depend upon the specific enzyme or combination of enzymes utilized but will generally be in the range of about 9–12, preferably 9–11.

The combination of the enzyme treatment to produce the enhanced scouring effect with another processing step such as desizing or bio-polishing would greatly extend the industrial utility of the invention.

For purposes of this invention "cellulosic material" will include fibers, yarn and fabric made from natural cellulosic fibers including cotton, linen, flax, ramie or their blends. In addition blends of these natural fibers with manmade fibers such as polyester, rayon, Tencel, etc. would also benefit from this technology.

In a preferred embodiment of the invention a 100% cotton knitted or desized woven textile fabric is treated with the aqueous enzyme solution comprising a Bacillus sp. pectate lyase at a level of 0.1–50 APSU/g fabric, a Humicola sp. cellulase at a level of 0.1–50 CEVU/g fabric and a Bacillus sp. protease at a level of 0.01–1.0 KNPU/g fabric at a pH range of 9–12 and at a temperature range of 20–65° C. for 2–18 hours. In the case of a greige woven cotton fabric, the alpha-amylase enzyme from a Bacillus sp. at a level of 0.1–25 KNU/g fabric and a Humicola sp. lipase at a level of 0.1–5.0 KLU/g fabric is added to the mixture so as to effect a simultaneous desizing and enhanced scouring effect. The cellulase dosage during the reaction period can be adjusted so that a simultaneous bio-polishing and enhanced scouring effect takes place.

Optionally, the cellulosic material can be exposed to a chemical treatment such as a bleaching process or a combined scour/bleach process consisting of, for example, the use of hydrogen peroxide or other oxidizing agent. The enhanced scouring effect due to the enzyme action on the cellulosic material has been shown to be more responsive to a subsequent bleach procedure resulting in an enhanced whiteness response. The enzyme effect can be exploited either by the ability to produce a whiter material with the same level of subsequent chemicals or by using a decreased level of chemicals resulting in equivalent whiteness complemented with other superior fabric characteristics.

B. Enzyme Solutions

In further embodiments, the aqueous enzyme solution of the invention include, in addition to pectinase, protease, glucanase, cellulase, and/or galactanase. As shown below, the enzyme solution of the invention yields an enhanced whiteness effect of cellulosic material. Such enzymes and their resultant combinations have been discovered through an intensive evaluation system whereby the response of the enzyme treated cellulosic material to a subsequent scouring stage is determined. Other critical fabric quality parameters such as the effects on strength, resistance to pilling, water absorbency and dyeability have also been studied for the various novel enzyme solutions.

The aqueous enzyme solution of the invention, or any other enzyme incorporated in the enhanced bleach response composition, is normally incorporated in the textile scouring or cleaning composition at a level from 0.00001% to 2% of enzyme protein by weight of the composition, preferably at a level from 0.0001% to 1% of enzyme protein by weight of the composition, more preferably at a level from 0.001% to 0.5% of enzyme protein by weight of the composition, even more preferably at a level from 0.01% to 0.2% of enzyme protein by weight of the composition.

Pectinases.

Any pectinolytic enzyme composition with the ability to degrade the pectin composition of plant cell walls will have utility in the invention. Suitable pectinases include those of fungal or bacterial origin. Particularly useful pectinases for this invention will be those derived from alkalophilic microorganisms. Chemically or genetically modified mutants are included. Preferred pectinases can be polygalacturonase or calcium-independent pectate lyase, alone or in combination with pectine methyl esterase, and can be chosen from monocomponent activities for reasons of improved functionality and production efficiency. Examples of pectinases useful for this invention include complex and monocomponent enzymes from bacterial sources such as those from Bacillus, Clostridium, Pseudomonas, Xanthomonas and Erwinia.

Pectinases are normally incorporated in the aqueous enzyme composition at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

The activity of pectinase enzymes relevant for this invention can conveniently be measured using a pectic acid substrate at pH 8 (APSU) as measured by an alkaline modification of the PSU method as described below (Novo Nordisk publication AF269).

Proteases.

Any protease providing an enhanced protein removal of cellulosic material can be used. Suitable proteases include those of animal, vegetable or microbial origin. Microbial origin is preferred. Particularly useful proteases for this invention will be those derived from alkalophilic microorganisms. Chemically or genetically modified mutants are included. The protease may be a serine protease, preferably an alkaline microbial protease or a trypsin-like protease. Examples of alkaline proteases are subtilisins, especially those derived from Bacillus, e.g., subtilisin Novo, subtilisin Carlsberg, subtilisin 309, subtilisin 147 and subtilisin 168 (described in WO 89/06279). Examples of trypsin-like proteases are trypsin (e.g., of porcine or bovine origin) and the Fusarium protease described in WO 89/06270.

Protease enzymes may be incorporated into the aqueous enzyme compositions in accordance with the invention at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

The activity of protease enzymes relevant for this invention can conveniently be measured using a hemoglobin substrate (AU) or dimethyl casein (KNPU) described in Novo Nordisk publications, AF4 and AF219 respectively.

Cellulases.

Any cellulase suitable for providing an enhanced surface structure of cellulosic material can be used. Suitable cellulases include those of bacterial or fungal origin. Particularly useful cellulases for this invention will be those derived from alkalophilic microorganisms. Chemically or genetically modified mutants are included. Preferred cellulases will be monocomponent activities for reasons of improved functionality and production economy. Well described cellulases can be produced by Trichoderma sp. Suitable cellulases are disclosed in U.S. Pat. No. 4,435,307, which discloses fungal cellulases produced from *Humicola insolens*. The cellulase system is a group of enzyme families encompassing endo- and exo- activities as well as cellobiose hydrolyzing capability. Cellulase enzymes consist of a core catalytic domain and a binding domain. The functionality of these enzymes consequently is dependent upon the natural or engineered amino acid sequence in the protein primary structure. Especially suitable cellulases are those monocomponent natural or engineered varieties exhibiting low strength losses. Examples of such cellulases are cellulases described in European patent application No. 0 495 257.

Cellulases are normally incorporated in the aqueous enzyme composition at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

The activity of cellulase enzymes relevant for this invention can conveniently be measured using a CMC substrate at pH 9 (CEVU) or at pH 6 (EGU) as described in Novo Nordisk publication, AF253.

Non-Cellulolytic b-Glucanases.

Any beta-glucanase suitable for producing an enhanced (xylo)glucan removal from cellulosic material can be used. Suitable beta-glucanases, including xyloglucanase, can be of fungal or bacterial origin. Chemically or genetically modified mutants are included. Preferred beta-glucanases will be monocomponent activities for reasons of improved functionality and production efficiency.

Beta-glucanases are normally incorporated in the aqueous enzyme composition at a level of from 0.00001% to 2% of enzyme protein by weight of the composition, preferably at a level of from 0.0001% to 1% of enzyme protein by weight of the composition, more preferably at a level of from 0.001% to 0.5% of enzyme protein by weight of the composition, even more preferably at a level of from 0.01% to 0.2% of enzyme protein by weight of the composition.

Non-cellulolytic b-glucanases suitable for this invention can be measured using the specific substrate according to the method described in Novo Nordisk publication AF70 (available upon request).

It should be appreciated that any mixture of the above referenced enzymes causing an increased whiteness effect are encompassed herein, in particular a mixture of complex or monocomponent activities including cellulase, non cellulolytic b-glucanase, pectinase, and protease.

Textile Surfactants.

In another embodiment the present invention is directed to an aqueous composition comprising the described aqueous enzyme solution plus a surfactant exhibiting a compatible or synergistic response with the enhanced whitening effect. The surfactant fortified compositions according to the present invention comprise a surfactant system, wherein the surfactant can be selected from nonionic and/or anionic and/or cationic and/or ampholytic and/or zwitterionic and/or semi-polar surfactants in combination with the enzymes.

The surfactant is typically present at a level from 0.1% to 60% by weight and is most preferably formulated in such a way that it promotes, or at least does not degrade, the stability of any enzyme in these compositions.

Preferred systems to be used according to the present invention comprise as a surfactant one or more of the nonionic and/or anionic surfactants described herein. Polyethylene, polypropylene, and polybutylene oxide condensates of alkyl phenols are suitable for use as the nonionic surfactant of the surfactant systems of the present invention, with the polyethylene oxide condensates being preferred. The condensation products of primary and secondary aliphatic alcohols with about 1 to about 25 moles of ethylene oxide are suitable for use as the nonionic surfactant of the nonionic surfactant systems of the present invention. Also useful as the nonionic surfactant of the surfactant systems of the present invention are alkylpolysaccharides disclosed in U.S. Pat. No. 4,565,647. The condensation products of ethylene oxide with a hydrophobic base formed by the condensation of propylene oxide with propylene glycol are also suitable for use as the additional nonionic surfactant systems of the present invention. Also suitable for use as the nonionic surfactant of the nonionic surfactant system of the present invention, are the condensation products of ethylene oxide with the product resulting from the reaction of propylene oxide and ethylenediamine.

Highly preferred anionic surfactants include alkyl alkoxylated sulfate surfactants and the analogous phosphate esters. Suitable anionic surfactants to be used are alkyl ester sulfonate surfactants including linear esters of C8–C20 carboxylic acids (i.e., fatty acids) which are sulfonated with gaseous SO3 according to "The Journal of the American Oil Chemists Society", 52 (1975), pp. 323–329. Other anionic surfactants useful for textile cleaning purposes can also be included in the aqueous enzyme compositions of the present invention. The aqueous enzyme compositions of the present invention may also contain cationic, ampholytic, zwitterionic, and semi-polar surfactants, as well as the nonionic and/or anionic surfactants other than those already described herein.

When included therein, the aqueous enzyme compositions of the present invention typically comprise from about 1% to about 40%, preferably from about 3% to about 20% by weight of such surfactants.

Antifoaming agents.

Another optional ingredient is a foam suppressor, or antifoaming agent exemplified by silicones, and silica-silicone mixtures. The antifoaming agents described above are normally employed at levels of from 0.001% to 2% by weight of the composition, preferably from 0.01% to 1% by weight.

Other components.

Other components used in textile cleaning compositions may be employed such as soil-suspending agents, soil-releasing agents, abrasives or bactericides.

Enzyme Formulation.

The physical form of the enzyme product resulting in an enhanced whiteness effect on cellulosic materials according to the invention can be in liquid, paste, gels, bars or low-dusting granular forms. In a preferred embodiment, the aqueous enzyme composition will be formulated as a "slurry"; that is, as a concentrated suspension of the enzymes in a medium consisting predominantly of the co-formulated surfactant composition.

C. Cellulosic Material

The present invention is directed to a cellulosic material exhibiting enhanced effect on removal of non-cellulytic material which is produced by a process using the novel method of aqueous enzyme treatment. Cellulosic material, for purposes of the present invention is defined as fiber or fabric derived from natural sources of cellulosics such as cotton, flax, linen, ramie and their blends. Blends of the aforementioned fibers with manmade fibers such as those derived from polyester, rayon, Tencel would also benefit from the invention. The superior cellulosic material is comprised of more of the desirable original fiber components, a less degraded cellulose, is more responsive to subsequent caustic scouring operations; all of which properties result in value enhancement of the textile product while at the same time offering process benefits of decreased chemical utilization and waste.

D. Alkaline APSU assay

APSU units.

The APSU units is a viscosity measurement using the substrate polygalacturonic acid with no added Calcium. Substrate: 5% Polygalacturonic acid sodium salt (Sigma P-1879) is solubilised in 0.1 M Glycin buffer pH 10.4 ml substrate is preincubated 5 min at 40° C. 250 $\mu$l of the enzyme (or enzyme dilution) is added and mixed for 10 sec on a mixer at the higest speed, it is then incubated for 20 min at 40° C. The viscosity is measured using a MIVI 600 from the company Sofraser, 45700 Villemandeur, France. The viscosity is measured as mV after 10 sec. For calculation of APSU units the table below can be used:

| APSU/ml | mV |
|---|---|
| 0.00 | 300 |
| 4.00 | 276 |
| 9.00 | 249 |
| 14.00 | 227 |
| 19.00 | 206 |
| 24.00 | 188 |
| 34.00 | 177 |
| 49.00 | 163 |
| 99.00 | 168 |

EXAMPLES

The following examples are put forth so as to provide those of ordinary skill in the art with a complete disclosure and description of how to make and use the method of the invention, and are not intended to limit the scope of what the inventors regard as their invention. Efforts have been made to ensure accuracy with respect to numbers used (e.g. amounts, temperature, etc.) but some experimental errors and deviations should be accounted for. Unless indicated otherwise, parts are parts by weight, molecular weight is weight average molecular weight, temperature is in degrees Centigrade, and pressure is at or near atmospheric.

Example 1

Standard Industry Scouring Procedure

To simulate standard industrial scouring conditions, cotton fabric, knitted or desized woven goods, as represented by Test Fabrics #428U, was contacted with solutions of sodium hydroxide at percentages ranging from 0% to 5% on weight of goods for one hour at a temperature of 90° C. The ratio of processing liquor to fabric was 10:1. The processing liquor contained 0.25% Callaway Discoterge 1467, a caustic-compatible detergent to aid the scouring process. After the reaction period, the fabric was rinsed well to remove residual scour bath. The fabric was then rinsed with 5 g/L pH 5 sodium acetate in order to bring all fabric to a constant pH and finally washed with water and air dried. The fabric was then equilibrated in a constant temperature humidity chamber for at least 24 hours before any subsequent measurements or procedure. The reflectance of the fabric was measured and expressed as the difference before and after the scour treatment. For a 100% cotton medium weight twill fabric, the difference in reflectance in Ganz whiteness units for a scour treatment using 1 mole of sodium hydroxide per kilo of fabric was 15 units. The relationship shown in Table 1 has been found for a 100% medium weight woven twill fabric.

Example 2

Standard Industry Bleaching Procedure

The scoured fabrics were then bleached with hydrogen peroxide at levels ranging from 0 to 10% (0–2.9 moles hydrogen peroxide per kilo fabric) on weight of goods at a 10:1 liquor ratio for 60 minutes at 70° C. The bleach bath solution, adjusted to a pH of 10.8, contained 0.3% sodium silicate and 0.25% peroxide stabilizer/sequestrant (Callaway Discol 1612). After the bleach treatment the fabrics were rinsed free of bleach bath solution and then rinsed with 5 g/L pH5 sodium acetate in order to bring all fabric to a constant pH and finally washed with water and air dried. The fabrics were then equilibrated in a constant temperature humidity chamber for at least 24 hours before any subsequent measurements or procedures. The reflectance of the fabric was measured and expressed as the difference before and after the bleach treatment. As can be seen in Table 2, the response of the fabric is dependent upon the prior treatment. Two regimes of peroxide response are seen—one having been scoured at 0.25 mole sodium hydroxide or less results in a greater response to hydrogen peroxide than fabric scoured at 0.5 moles sodium hydroxide per kilo and above. A clear trend is seen for a lower response to a bleach for fabric prescoured to higher initial levels of whiteness.

Example 3

Enzyme Solution Treatment Of Cellulosic Material at pH 11 Followed by Conventional Chemical Treatment A 100% cotton woven twill fabric, desized Test Fabric #428U, representing a typical cellulosic material, was treated with an aqueous enzyme solution comprising a Humicola sp. cellulase (5 CEVU/g fabric), a Bacillus sp. hemicellulase (4 EXU/g fabric), a Bacillus sp. pectinase (16 APSU/g fabric), a Bacillus sp. protease (0.06 KNPU/g fabric) and a Humicola sp. lipase (0.8 KLU/g fabric) at a 10:1 liquor ratio, at pH 11 and at a temperature of 48° C. for 4 hours. The fabric was rinsed well after the enzyme treatment, immersed in 5 g/L pH 5 acetate buffer followed by another water rinse. The reflectance of the dried fabric was measured in Ganz units and compared to a no enzyme control. The enzyme treated fabric was found to have an enhanced response vs the control fabric of 0.27 sodium hydroxide equivalents. The fabrics were then treated with a pH 10.8 bleach bath consisting of 0.05% hydrogen peroxide, 0.3% sodium silicate and 0.25% Discol 1612 chelator at a 10:1 liquor ratio at 60° C. for 45 minutes. The fabrics were then rinsed in water, equilibrated to a pH of 5 with 5 g/L sodium acetate, rinsed again with water, dried and the reflectance measured in Ganz whiteness units. The enzyme treated and bleached sample was found to be 3 Ganz units whiter than the control fabric.

Example 4

Enzyme Solution Treatment Of Cellulosic Material at pH 12 Followed by Conventional Chemical Treatment A 100% cotton woven twill fabric, desized Test Fabric #428U, was treated with an aqueous enzyme solution comprising a Humicola sp. cellulase (5 CEVU/g fabric), a Bacillus sp. hemicellulase (4 EXU/g fabric), a Bacillus sp. pectinase (16 APSU/g fabric), a Bacillus sp. protease (0.06 KNPU/g fabric) and a Humicola sp. lipase (0.8 KLU/g fabric) at a 10:1 liquor ratio, at pH 12 and at a temperature of 48° C. for 4 hours. The fabric was rinsed well after the enzyme treatment, immersed in 5 g/L pH 5 acetate buffer followed by another water rinse. The reflectance of the dried fabric was measured in Ganz units and compared to a no enzyme control. The enzyme treated fabric was found to have an enhanced response vs the control fabric of 0.15 sodium hydroxide equivalents. The fabrics were then treated with a pH 10.8 bleach bath consisting of 0.05% hydrogen peroxide, 0.3% sodium silicate and 0.25% Discol 1612 chelator at a 10:1 liquor ratio at 60° C. for 45 minutes. The fabrics were then rinsed in water, equilibrated to a pH of 5 with 5 g/L sodium acetate, rinsed again with water, dried and the reflectance measured in Ganz whiteness units. The enzyme treated and bleached sample was whiter than the control fabric and exhibited a hydrogen peroxide response factor of 1.02.

Example 5

Treatment Of Cellulosic Material With Aqueous Enzyme Solution Followed By Reduced Chemical Treatment A 100% cotton woven twill fabric, desized Test Fabric #428U, was treated with an aqueous enzyme solution as described in Example 3 at a pH of 11 at a temperature of 48° C. for 4 hours. The fabric was rinsed well after the enzyme treatment, immersed in 5 g/L pH 5 acetate buffer followed by another water rinse. The reflectance of the dried fabric was measured in Ganz units and compared to a no enzyme control.

The fabric is then bleached to a Ganz whiteness of 75 using a bleach bath consisting of 0.3% hydrogen peroxide, 0.3% sodium silicate, 0.25% Discol 1612 chelator at a liquor ratio of 10:1 at a temperature of 70° C. for 60 minutes.

A control fabric was prepared by using a conventional caustic treatment of 0.3% NaOH for one hour at 90° C. The fabric was then bleached to a Ganz whiteness of 75 using a bleach bath consisting of 0.6% hydrogen peroxide, 0.3% sodium silicate, 0.25% Discol 1612 chelator at a liquor ratio of 10:1 at a temperature of 70° C. for 60 minutes.

The fabric treated with the simultaneous enzyme scour at pH 11 and subsequently bleached is found to exhibit a superior fabric quality characteristic relative to the conventionally scoured at pH 13 and bleached sample as judged by a panel evaluating the hand of the fabric.

Example 6

Enzyme Solution Treatment Of Cellulosic Material Resulting in a Simultaneous Enhanced Whiteness Effect and Desizing A 100% cotton woven textile fabric, Test Fabric #400R, representing a typical cellulosic material, was treated with an aqueous enzyme solution comprising, in addition to that described in Example 3, amylase at a level of 1.5 KNU/g fabric at a pH of 11 at a temperature of 48° C. for 4 hours. The fabric was rinsed well after the enzyme treatment, immersed in 5 g/L pH 5 acetate buffer followed by another water rinse. The reflectance of the dried fabric was measured in Ganz units and compared to a no enzyme control.

An iodine starch test on the fabric following the treatment indicated a better removal of starch from the combined process than a similar treatment using amylase alone.

Example 7

Enzyme Solution Treatment Of Cellulosic Material Resulting in an Enhanced Whiteness Effect A 100% cotton knitted fabric, Test Fabric #460u, representing a typical cellulosic material, was treated with an aqueous enzyme solution comprising a Humicola sp. cellulase (10 CEVU/g fabric), a Bacillus sp. hemicellulase (4 EXU/g fabric), a Bacillus sp. pectinase (16 APSU/g fabric), a Bacillus sp. protease (0.06 KNPU/g fabric) and a Humicola sp. lipase (0.8 KLU/g fabric) at a 10:1 liquor ratio, at a pH of 11 and a temperature of 48° C. for 4 hours. The fabric was rinsed well after the enzyme treatment, immersed in 5 g/L pH 5 acetate buffer followed by another water rinse. The reflectance of the dried fabric was measured in Ganz units and compared to a no enzyme control. In addition, the enzyme treated and control fabrics are evaluated for pilling note using a Martindale apparatus at 150, 500 and 200 revolutions. The enzyme treated fabric exhibits a pilling note of 4–5 whereas the no enzyme controls were at a pilling note of 2–3.

Example 8

Enzyme Solution Treatment Of Cellulosic Material in the Presence of Surfactant Resulting in a Superior Enhanced Whiteness Effect A 100% cotton woven textile fabric, desized Test Fabric #400R, representing a typical cellulosic material, was treated with an aqueous enzyme solution described in Example 3 plus a surfactant, and sequestrant adjunct complex at a level of 2.5% on weight of goods at a pH range of 11–12 at temperature of 48° C. for 4 hours. The fabric is rinsed well after the enzyme treatment, immersed in 5 g/L pH 5 acetate buffer followed by another water rinse. The reflectance of the dried fabric was measured in Ganz units and compared to a no enzyme control. The fabric is then treated with a hydrogen peroxide bleach process as described in Example 3 and the difference in peroxide response compared for treatments in the presence of the various surfactants and adjuncts tested. The peroxide response factors for the following surfactants are shown in Table 3.

Example 9

Enzyme Solution Derived from Monocomponent Activities Treatment Of Cellulosic Material Resulting in a Superior Enhanced Whiteness Effect A. A 100% cotton woven twill fabric, desized Test Fabric #428U, is treated with an aqueous enzyme solution comprising a monocomponent Humicola sp. cellulase (5 CEVU/g fabric), a Bacillus sp. hemicellulase (4 EXU/g fabric), a Bacillus sp. pectinase (16 APSU/g fabric), a Bacillus sp. protease (0.06 KNPU/g fabric) and a Humicola sp. lipase (0.8 KLU/g fabric) at a 10:1 liquor ratio, at a pH of 11, at a temperature of 48° C. for 4 hours. The fabric is rinsed well after the enzyme treatment, immersed in 5 g/L pH 5 acetate buffer followed by another water rinse. The reflectance of the dried fabric was measured in Ganz units and compared to a no enzyme control. The fabrics are then treated with a 0.05% solution of hydrogen peroxide under the conditions described in Example 3. The fabrics are then rinsed in water, equilibrated to a pH of 5 with 5 g/L sodium acetate, rinsed again with water, dried and the reflectance measured in Ganz whiteness units. The reflectance of the sample treated with an aqueous enzyme solution containing a monocomponent cellulase is found to exhibit a similar response as in Example 3. A strength measurement using an Instron apparatus indicated the monocomponent treated sample to retain more of the original fabric strength than the sample treated with the complex cellulase as in Example 3.

B. A 100% cotton woven twill fabric, desized Test Fabric #428U, was treated with an analogous aqueous enzyme solution as described in Example 3 including a monocomponent Bacillus sp. hemicellulase (4 EXU/g fabric). The fabric was rinsed well after the enzyme treatment, immersed in 5 g/L pH 5 acetate buffer followed by another water rinse. The reflectance of the dried fabric was measured in Ganz units and compared to a no enzyme control. The fabrics was then treated with a 0.05% solution of hydrogen peroxide under the conditions described in Example 3. The fabrics were then rinsed in water, equilibrated to a pH of 5 with 5 g/L sodium acetate, rinsed again with water, dried and the reflectance measured in Ganz whiteness units. The reflectance of the sample treated with an aqueous enzyme solution containing a monocomponent hemicellulase was found to exhibit a similar response as in Example 3.

C. A 100% cotton woven twill fabric, desized Test Fabric #428, representing a typical cellulosic material, was treated with an analogous aqueous enzyme solution as described in Example 3 including a monocomponent Bacillus sp. pectinase (16 APSU/g fabric). The fabric was rinsed well after the enzyme treatment, immersed in 5 g/L pH 5 acetate buffer followed by another water rinse. The reflectance of the dried fabric was measured in Ganz units and compared to a no enzyme control. The fabrics was then treated with a 0.05% solution of hydrogen peroxide under the conditions described in Example 3. The fabrics were then rinsed in water, equilibrated to a pH of 5 with 5 g/L sodium acetate, rinsed again with water, dried and the reflectance measured in Ganz whiteness units. The reflectance of the sample treated with an aqueous enzyme solution containing a monocomponent pectinase was found to exhibit a similar response as Example 3.

Example 10

Enzyme Treatment of Cellulosic Material Effect of Temperature on Whiteness and Wettability A 100% cotton woven twill fabric, desized Test Fabric #428U, was treated with an aqueous enzyme solution comprising a monocomponent Humicola sp. cellulase (18 CEVU/g fabric), a Bacillus sp. pectinase (0.15 APSU/g fabric), a Bacillus sp. protease (0.07 KNPU/g fabric) and a Humicola sp. lipase (0.33 KLU/g fabric) at a 10:1 liquor ratio, at a pH of 9, at a temperature of 35–75° C. for 4 hours. The fabric was rinsed well after the enzyme treatment, immersed in 5 g/L pH 5 acetate buffer followed by another water rinse. The reflectance of the dried fabric was measured in Ganz units and compared to a no enzyme control as shown in Table 4. The wettability (drop test—measuring the time in seconds for a drop of water to be absorbed by the fabric) was measured and compared to a no enzyme control as shown in Table 5. The beneficial effect of increasing temperature is clearly seen on both responses.

Example 11

Pectate Lyase Treatment of Cellulosic Material Effect of pH on Pectin Removal A 100% cotton woven twill fabric, desized Test Fabric #428U, was treated for 2 hours with an aqueous enzyme solution comprising a Bacillus sp. pectate lyase (9 APSU/g fabric) at a 15:1 liquor ratio, at a temperature of 55° C., and at pH of 9–11. The fabric was rinsed well after the enzyme treatment and dried and then dyed with Ruthenium Red. The dye uptake was measured spectrophotometrically and is a measure of the residual pectin on the fiber. The percentage of residual pectin is calculated using the starting material as 100% residual pectin and a fully chemically scoured and bleached fabric as 0% residual pectin. The results are shown in Table 6.

Example 12

Pectate Lyase and Protease Treatment of Cellulosic Material Effect of pH on Pectin Removal and Ganz Whiteness A 100% cotton woven twill fabric, desized Test Fabric #428U, was treated for 2 hours with an aqueous enzyme solution comprising a Bacillus sp. pectate lyase (9 APSU/g fabric) and a Bacillus sp. protease (0.07 KNPU/g fabric) at a 15:1 liquor ratio, at a temperature of 55° C., and at pH of 8–11. The fabric was rinsed well after the enzyme treatment, dried and then dyed with Ruthenium Red. Dye uptake was measured as described above. The percentage of residual pectin is calculated using the starting material as 100% residual pectin and a fully chemically scoured and bleached fabric as 0% residual pectin. Ganz Whiteness was also measured and compared with the whiteness obtained at the same pH without enzymes added. The results are shown in Table 7. A substantial increase in whiteness was obtained.

Example 13

Pectate Lyase, Protease and Cellulase Treatment of Cellulosic Material Effect of Time on Pectin Removal A 100% knitted cotton fabric, Test Fabric #460U, was treated for 0.5, 1 and 2 hours with an aqueous enzyme solution comprising a Bacillus sp. pectate lyase (0.15 APSU/g fabric), a Bacillus sp. protease (0.01 AU/g fabric) and a monocomponent cellulase (35 ECU/g fabric) at a 10:1 liquor ratio, at a temperature of 55° C., and at pH of 9.5. The fabric was rinsed well after the enzyme treatment, dried and then dyed with Ruthenium Red. Dye uptake was measured as described above. Results are shown in Table 8. The results showed that a substantial amount of pectin is removed at 0.5 hour, and very little pectin is removed after 1 hour.

Example 14

Pectate Lyase Treatment of Cellulosic Material Effect of Calcium and EDTA on Pectin Removal A 100% woven cotton fabric, desized Test Fabric #428U, was treated for 2 hours with an aqueous enzyme solution comprising a Bacillus sp. pectate lyase (0.15 APSU/g fabric)

and either up to 1.0 mM calcium or 1.5 mM EDTA, at a temperature of 55° C., and at pH of 9. The fabric is rinsed well after the enzyme treatment, dried and then dyed with Ruthenium Red. Dye uptake was measured as described above. Results are shown in Table 9.

TABLE 1

Sodium Hydroxide Influence on Whiteness Response After Scouring

| moles NaOH/kg cotton | increase in Ganz whiteness difference |
|---|---|
| 0.00 | −2 |
| 0.25 | 3 |
| 0.50 | 11 |
| 0.75 | 14 |
| 1.00 | 15 |

TABLE 2

Influence of Concentration of Sodium Hydroxide in Scour and Hydrogen Peroxide in Bleach on Increase of Ganz Whiteness During Bleaching

| moles NaOH/kg | moles $H_2O_2$/kg cotton in bleach | | | | | |
|---|---|---|---|---|---|---|
| cotton in scour | 0.30 | 0.60 | 1.20 | 1.80 | 2.40 | 2.90 |
| 0.00 | 37.2 | 40.4 | 46.8 | 49.3 | 51.0 | 52.2 |
| 0.25 | 39.4 | 41.6 | 44.5 | 49.3 | 50.6 | 50.6 |
| 0.50 | 31.9 | 35.9 | 39.6 | 40.5 | 42.2 | 42.7 |
| 0.75 | 31.3 | 35.9 | 37.4 | 38.1 | 39.8 | 40.8 |
| 1.00 | 31.3 | 34.5 | 38.0 | 39.9 | 40.3 | 41.9 |

TABLE 3

Relative Improvement of Whiteness Increase During Bleaching

| surfactant | response factor |
|---|---|
| Berol 08 | 1.2 |
| Kierolon OL | 1.3 |
| Deksol S | 1.5 |
| Novosol P | 1.2 |
| Lutensol AT | 0.8 |
| Superonic LF | 1.1 |
| Superonic NPE | 1.3 |

TABLE 4

Ganz whiteness. Treatment at Different Temperatures, ± Enzymes

| Temp., ° C. | 35 | 45 | 55 | 65 | 75 |
|---|---|---|---|---|---|
| no enzyme | 23.2 | 22.6 | 22.8 | 23.6 | 25.3 |
| enzyme | 25.1 | 26.0 | 27.1 | 28.3 | 30.0 |

TABLE 5

Wettability in Seconds. Treatment at Different Temperatures, ± Enzymes

| Temp., ° C. | 35 | 45 | 55 | 65 | 75 |
|---|---|---|---|---|---|
| no enzyme | 31.6 | 29.3 | 28.8 | 11.8 | 10.5 |
| enzyme | 14.6 | 7.5 | 7.5 | 6.1 | 2.5 |

TABLE 6

PH Influence on Removal of Pectin

| pH | 9 | 10 | 10.5 | 11 |
|---|---|---|---|---|
| % residual pectin | 42 | 35 | 53 | 72 |

TABLE 7

PH Influence on Removal of Pectin

| pH | 9 | 10 | 10.5 | 11 |
|---|---|---|---|---|
| delta Ganz Whiteness | 5.8 | 6.1 | 6.5 | 6.5 |

TABLE 8

Pectin Removal as Function of Time

| Time | 0.5 hour | 1 hour | 2 hours |
|---|---|---|---|
| % residual pectin | 38 | 25 | 20 |

TABLE 9

Influence of calcium and EDTA on pectin removal

| mM calcium | 1.0 | 0.5 | 0.2 | 0 | 0 | 0 | 0 | 0 |
|---|---|---|---|---|---|---|---|---|
| mM EDTA | 0 | 0 | 0 | 0 | 0.2 | 0.5 | 1.0 | 1.5 |
| % residual pectin | 31.3 | 29.8 | 30.7 | 33.3 | 35.9 | 36.1 | 37.3 | 36.3 |

What is claimed is:

1. A method for removing non-cellulosic materials from cotton, said method comprising contacting the cotton with an aqueous solution comprising pectate lyase at a pH of about 9.0 or above and a calcium ion concentration of less than 0.2 mM, under conditions that result in removal of said non-cellulosic materials.

2. A method as defined in claim 1, wherein said contacting is performed at a temperature of about 50° C. or above.

3. A method as defined in claim 1, wherein said aqueous solution further comprises one or more enzymes selected from the group consisting of protease, glucanase, and cellulase.

4. A method as defined in claim 1, wherein said aqueous solution further comprises a calcium ion sequestrant.

5. A method as defined in claim 4, wherein said calcium ion sequestrant is selected from the group consisting of aluminosilicates, silicates, polycarboxylates fatty acids, ethylenediamine tetraacetate, aminopolyphosphonates, ethylenediamine tetramethylene phosphonic acid, and diethylene triamine pentamethylenephosphonic acid.

6. A method for removing non-cellulosic materials from a cellulosic material, said method comprising contacting the cellulosic material with an aqueous solution comprising pectate lyase at a pH of about 9.0 or above and a calcium ion concentration of less than 0.2 mM, under conditions that result in removal of said non-cellulosic materials.

* * * * *